US012747637B2

(12) United States Patent
Nash

(10) Patent No.: US 12,747,637 B2
(45) Date of Patent: Sep. 29, 2026

(54) METHOD TO EXTEND PDC BIT LIFE AND IMPROVE DRILLING SPEED BY MITIGATING SLIP-STICK

(71) Applicant: Kenneth L Nash, Spring, TX (US)

(72) Inventor: Kenneth L Nash, Spring, TX (US)

( * ) Notice: Subject to any disclaimer, the term of this patent is extended or adjusted under 35 U.S.C. 154(b) by 0 days.

(21) Appl. No.: 19/001,339

(22) Filed: Dec. 24, 2024

(65) Prior Publication Data

US 2025/0129672 A1 Apr. 24, 2025

Related U.S. Application Data

(63) Continuation-in-part of application No. 18/107,717, filed on Feb. 9, 2023, now Pat. No. 12,196,071, which is a continuation-in-part of application No. 17/058,839, filed as application No. PCT/US2019/034325 on May 29, 2019, now Pat. No. 11,603,752.

(60) Provisional application No. 62/821,006, filed on Mar. 20, 2019, provisional application No. 62/689,430, filed on Jun. 25, 2018, provisional application No. 62/683,226, filed on Jun. 11, 2018, provisional application No. 62/677,955, filed on May 30, 2018.

(51) Int. Cl.
*E21B 10/567* (2006.01)
*E21B 19/10* (2006.01)

(52) U.S. Cl.
CPC ..... *E21B 10/567* (2013.01); *E21B 19/10* (2013.01)

(58) Field of Classification Search
CPC ..... E21B 10/567; E21B 19/10
See application file for complete search history.

(56) References Cited

U.S. PATENT DOCUMENTS

| | | | | |
|---|---|---|---|---|
| 6,082,457 | A | 7/2000 | Best | |
| 6,241,032 | B1 | 6/2001 | Falgout | |
| 2004/0238219 | A1* | 12/2004 | Nichols | E21B 17/07 175/320 |
| 2005/0183892 | A1 | 8/2005 | Oldham | |
| 2005/0211473 | A1 | 9/2005 | Zupanick | |

FOREIGN PATENT DOCUMENTS

| | | |
|---|---|---|
| WO | 2004109052 | 12/2004 |
| WO | 2014107232 | 7/2014 |

* cited by examiner

*Primary Examiner* — Dany E Akakpo
(74) *Attorney, Agent, or Firm* — Kenneth L. Nash; Thomas D. Nash

(57) ABSTRACT

A system to improve drill bit performance of a PDC (polycrystalline diamond compact) drill bit by releasing torsional energy in the drilling string produced by slip-stick. A slip apparatus is positioned in the drilling string for this purpose in or between a transition region of the BHA and the remaining drill pipe of the drilling string and the middle region of the drill pipe. Alternatively, the slip apparatus is positioned utilizing a computer programmed to select a position in the drilling string for releasing torsional energy produced by slip stick.

18 Claims, 4 Drawing Sheets

METHOD TO EXTEND PDC BIT LIFE AND IMPROVE DRILLING SPEED BY MITIGATING SLIP-STICK

BACKGROUND OF THE INVENTION

Field of the Invention

The present invention relates generally to enhancing Polycrystalline Diamond Compact (PDC) bit performance such as bit life and bit drilling speed by mitigating the detrimental effects of slip-stick by strategically positioning a downhole ratchet within the drill string. This innovative approach maximizes the release of excess torsional energy generated during slip-stick events, thereby stabilizing the drill string and promoting smoother, faster, and longer life of the bit i.e., more efficient drilling.

Description of the Background

Modern PDC drilling bits utilize cutters, which are very short and require constant contact with the wellbore bottom for optimal performance. Even minor axial variations in the drill string length can significantly hinder drilling efficiency. Unfortunately, a phenomenon known as "slip-stick" induces torsional oscillations that can actually cause the drill string to shorten and lengthen, disrupting this crucial contact.

Slip-stick presents a multitude of problems:

Bit Bounce: The fluctuating drill string length causes the bit to bounce off the wellbore bottom, accelerating bit wear and necessitating more frequent trips to replace it. This bouncing action also damages the wellbore itself, leading to further complications.

Reduced Drilling Efficiency: During slip-stick events, the bit loses optimal contact, reducing cutting efficiency and slowing drilling progress.

Wellbore Integrity Issues: The repeated impacts from bit bounce create an irregular wellbore, potentially causing problems with circulation, directional control, and cementing operations. The irregular wellbores so created can also hinder the installation of gravel packing screens and casing.

In essence, slip-stick negatively impacts drilling operations by reducing efficiency, increasing wear and tear on equipment, and compromising wellbore quality. It would be desirable to essentially improve completions of wellbores by reducing the effects of slip-stick.

Stick-Slip Basics

Sticking: The bit may grab the formation and slow or temporarily stop rotating while the rotary table or top drive at the surface or downhole motor continues turning. This builds up torsional potential energy in the drill string.

Slipping: When the built-up torque exceeds the resistance encountered by the bit, the bit suddenly breaks free and spins rapidly-exceeding the drilling rotation speed of the drill string applied by the drive. This releases the stored or potential energy.

Energy Distribution

Not Uniform: The twist and potential energy are not evenly distributed along the drill string. The highest concentration is typically in the drill string above the heavier and stiffer BHA and/or in areas with greater friction or bending.

Pulse-Like Release: When the bit slips, the stored energy may release more as a torsional wave that travels up the drill string rather than a uniform twisting with distribution over the entire length of the drill pipe. This wave isn't a single, clean pulse, but technically may be described as a complex series of oscillations with varying amplitudes and frequencies.

Reflections and Interactions: These torsional waves can reflect off changes in the drill string's properties (diameter, material, etc.) and interact with each other, leading to complex vibration patterns.

In some aspects it is similar to the wave that travels down a whip:

Cracking a whip generates a similar wave-like release of energy. The initial motion at the handle creates a wave that travels down the whip, increasing in velocity and eventually breaking the sound barrier at the tip.

Why this Matters

As explained hereinafter, understanding how this energy is distributed and released is useful for placement to maximize the amount of potential energy created by slip stick that is released from the drillstring. The potential energy created by slip stick is added to the normally existing torsional energy that is due to resistance of the pipe and bit to the wellbore during drilling. Absent slip stick, the potential energy that normally occurs during drilling tends to stabilize.

Preventing damage: Stick-slip can cause excessive stress on the drill string, leading to fatigue, wear, and even failure (twist-offs).

Optimizing drilling: By mitigating stick-slip as taught herein, you can improve drilling efficiency, reduce wear on equipment, and increase the life of the bit.

In More Detail

The energy in a drill string during stick-slip is a complex combination of stored torsional energy and propagating waves. It's not uniform and involves pulses of energy moving up the drill string, with reflections and interactions creating a dynamic and potentially damaging environment.

Slip-stick (stick-slip) can begin when the bit grabs the formation. The drilling string continues to rotate and build torsional energy in the drilling string. The bit then releases. Due to the additional torsional energy in the drilling string due to slip-stick, oscillations of slowing and speeding of the drill bit can occur. Full blown slip-stick results in the bit actually stopping. When the bit is released, the bit begins spinning at high speeds sometimes much higher than the drilling speed. The oscillation can continue indefinitely. Even at much lesser variations below full blown slip-stick, the drill string actually shortens and lengthens, which produces changes in the axial length of the drill string. The shortening and lengthening of the drill string can cause poor cutting and damage to the bits.

In some cases, full blown stick-slip at the lower portion of the drill string miles below the surface especially in higher angle holes or deeper holes is not readily detectable with surface sensors. Therefore surface controls to vary drilling speed to counteract the stick-slip may not be effective.

Whenever the drill bit is rotated for drilling into a formation, the drill string has torsional windup or torsional potential energy, just as a torsional spring might have when torque is applied thereto. When drilling, it is highly desirable that this torsional windup or potential energy be a constant value based on the torsional constant of the drill string, and not a varying or oscillating amount, which occurs with slip-stick.

The irregular drilling due to slip-stick damages the drilling string and damages the wellbore. Torsional vibrations may produce a twisted borehole that becomes the source for additional torque. Thus, the problem of torsional vibrations is self-reinforcing. For many reasons, it is desirable to drill a straighter hole with reduced spiraling effects along the desired drilling path.

For instance, it has been found that tortuosity, or spiraling effects frequently produced in the wellbore during drilling, is associated with degraded bit performance, forward and reverse bit whirl, an increased number of drill string trips, increased likelihood of losing equipment in the hole, increased circulation and mud problems due to the troughs along the spiraled wellbore, increased stabilizer wear, decreased control of the direction of drilling, decreased cementing reliability due to the presence of one or more elongated troughs, clearance problems for gravel packing screens, decreased ROP (rate or speed of drilling penetration), degraded logging tool response due to hole variations including washouts and invasion, decreased reliability of MWD (measurement while drilling) and LWD (logging while drilling) due to the vibrations generally associated therewith, and many other problems.

It would be desirable to improve drill bit performance, which for purposes herein is drill bit life and/or drill bit drilling speed, by reducing or limiting the effects of slip-stick.

It would be desirable to maintain torsional potential energy at a constant value that is typically related to friction acting of the drilling string. For example during drilling, depending on the wellbore, the drill string might twist three times over its length due to the friction and rotational force of the drive, whether a top drive, rotary table, downhole motor or the like. So long as these forces remain relatively constant, the drilling string is able to maintain the constant close contact of the drill bit for maximum cutting effects. It would be desirable to provide a tool that would stabilize torsional potential energy within as few cycles as possible after any slip stick events.

While systems that use surface controls to balance torsional potential energy are to some extent effective, they are limited in that energy variations must travel all the way to the surface to even be detected. The deeper the well, the higher the drilling angle, the less likely this is to occur which limits usefulness of surface controls.

Consequently, there remains a need to provide an improved downhole assembly to perform this function and keep the torsional potential energy of the drill string constant. It would be desirable to provide a tool that would drain energy from the drill string when the drill bit turns faster than the drilling rate but then immediately apply driving energy to the drill bit when the bit drops back to the drilling driving rate velocity rate. This effect would quickly stabilize the bit drilling speed, maximize bit life, maximize drill sting life, and improve the hole. It would be desirable that the tool be relatively inexpensive and simple. Those of skill in the art will appreciate the present invention which addresses the above problems.

SUMMARY OF THE INVENTION

Accordingly, it is an objective of the present invention to provide an improved drilling assembly and method by locating one or more ratchets in desired locations within the drill string.

Another objective of one embodiment of the present invention is to decay torsional pulses going up the drill string to stabilize torsional potential energy in the drill string.

Another objective of the present invention is to release the lower portion of a drillstring during drilling to stabilize torsional potential energy in the drillstring.

Another objective of the present invention is to limit axial lengthening/shortening oscillation of the drill string to the point where bit bounce is eliminated—for longer bit life and improved positioning of the PDC cutters to maximize drilling rate.

An objective is to provide faster drilling ROP (rate of penetration), longer bit life, and reduced stress applied to the drill string.

A feature of the present invention is a ratchet that allows the drill string below the ratchet to spin to release torsional energy and then drives the drill string as soon as it slows down.

An advantage of use of the present invention in the drillstring is faster drilling ROP (rate of penetration), longer bit life and reduced stress applied to the drill string.

Other examples of advantages include but are not limited to reduced stress on drill string joints, truer gauge borehole, improved circulation, improved cementing, improved lower noise MWD and LWD, improved wireline logging accuracy, improved screen assembly running and installation, fewer bit trips, reduced or elimination of tortuosity, reduced or elimination of drill string buckling, reduced hole washout, improved safety, and/or other benefits.

These and other objectives, features, and advantages of the present invention will become apparent from the drawings, the descriptions given herein, and the appended claims. However, it will be understood that the above-listed objectives, features, and advantages of the invention are intended only as an aid in understanding aspects of the invention, and are not intended to limit the invention in any way, and therefore do not form a comprehensive or restrictive list of objectives, and/or features, definitions, and/or advantages of the invention.

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions. One general aspect includes a system to improve drill bit performance of a PDC (polycrystalline diamond compact) drill bit by controlling slip-stick. The system also includes a first component of said slip apparatus being threadably connectable with said first tubular; a second component of said slip apparatus being threadably connectable with said second tubular; said first component and said second component being mechanically connected to lock said first tubular and said second tubular together to transmit rotational energy produced by said drive through first tubular and said second tubular while drilling with said pdc drill bit, said first component and said second component being mechanically connected to permit relative rotation between said first tubular and said second tubular in response to slip-stick. The system also includes said slip apparatus being positioned in or between said transition region and said middle region of said drilling string. Other embodiments of this aspect include corresponding computer systems, apparatus, and computer programs recorded on one or more computer storage devices, each configured to perform the actions of the methods.

Implementations may include one or more of the following features. The system may include: a computer programmed to make calculations on said drilling string for determining a position for mounting said slip apparatus in or between said transition region and said middle region of said drill pipe to control damping of torsional energy in said drilling string due to said slip-stick. Said computer is programmed to be capable of comparing an effect of slip-stick on said drilling string when said slip apparatus is positioned at different positions in said drilling string. Said slip apparatus may include a first gear mounted to rotate with said first tubular; a second gear mounted to rotate with said second tubular; and a rotating connection that permits rotation between said first tubular and said second tubular in response to slip-stick. Said slip apparatus may include a bias member that urges gear engagement between said first gear and said second gear. The system may include gear teeth on said first gear and said second gear may include surfaces that are angled with respect to an axis through said first tubular and said second tubular to permit rotationally sliding engagement of said gear teeth in response to said slip-stick, said gear teeth on said first gear and said second gear being arranged to otherwise lock together to allow said rotational drilling force to rotate said pdc drill bit. Said slip apparatus is operable without a downhole sensor. The system may include an electronic control and a downhole sensor to control operation of said slip apparatus. Implementations of the described techniques may include hardware, a method or process, or computer software on a computer-accessible medium.

One general aspect includes a method for drilling a wellbore with a pdc (polycrystalline diamond compact) drill bit. The method also includes providing a first component of said slip apparatus. The method also includes providing a second component of said slip apparatus. The method also includes said first component and said second component being mechanically connected to lock together to transmit said rotational drilling force produced by said drive through said length of drill pipe while drilling with said pdc drill bit, said first component and said second component being mechanically connected to permit relative rotation between said first component and said second component in response to slip-stick to thereby release torsional energy from said length of drill pipe produced by slip-stick. The method also includes positioning said slip apparatus in or between said transition region and said middle region of said drilling string. Other embodiments of this aspect include corresponding computer systems, apparatus, and computer programs recorded on one or more computer storage devices, each configured to perform the actions of the methods.

Implementations may include one or more of the following features. The method may include providing a first tubular and a second tubular that are connectable into said drilling string; providing a first gear in said first component that rotates with said first tubular; providing a second gear in said second component that rotates with said second tubular; providing that said first gear is biased into contact with said second gear; providing that said first gear and said second gear are operable to lock together to provide rotational drilling force through said length of drill pipe; and providing that said first gear and said second gear are responsive to slip-stick to slidingly rotate against each to thereby release said torsional energy in said drilling string produced due to said slip-stick while drilling said wellbore with said pdc bit. The method may include: providing a computer programmed to make calculations on said drilling string for determining a position for said slip apparatus in said length of drill pipe from a plurality of different positions in or between said transition region and said middle region of said drilling string to control damping of torsional energy in said drilling string due to said slip-stick. The method may include providing that said slip apparatus is operable without a downhole sensor. The method may include providing an electronic control and a downhole sensor to control operation of said slip apparatus. Implementations of the described techniques may include hardware, a method or process, or computer software on a computer-accessible medium.

One general aspect includes a method for drilling a wellbore with a pdc (polycrystalline diamond compact) drill bit. The method also includes providing that said slip apparatus is operable to drive said drilling string or to release torsional energy. The method also includes utilizing a processor to make torque and drag calculations on said drilling string, said drilling string may include a bha (bottom hole assembly) and a drill pipe portion. The method also includes said bha being at a lowermost position in said drill string, said bha may include a bit and components may include one or more of a bit sub, drill collar, heavyweight drill collar, heavy weight drill pipe, stabilizer, reamer, shock, hole opener, downhole motor, rotary steerable system, directional equipment, drilling while measurement equipment, steering unit, near bit inclination, non-magnetic drill collar, said bha being connected to said drill pipe portion of said drill string. The method also includes said drill pipe portion may include additional of said components may include one or more of a drill pipe, coiled tubing, heavyweight drill pipe, stabilizer. The method also includes utilizing said torque and drag calculations on said drill string for determining a position for said slip apparatus in said drilling string to control torsional energy in said drilling string produced by slip-stick. Other embodiments of this aspect include corresponding computer systems, apparatus, and computer programs recorded on one or more computer storage devices, each configured to perform the actions of the methods.

Implementations may include one or more of the following features. The method may include providing that said slip apparatus locks a first tubular and a second tubular in said drilling string together for transmitting said rotational drilling force through said drilling string when drilling with said pdc drill bit, and permits relative rotation between said first tubular and second tubular in response to slip-stick to thereby release torsional energy due to slip-stick from said drilling string. The method providing said slip apparatus may include a first gear slidably mounted to a first tubular in said drilling string and a second gear secured to a second tubular in said drilling string, said first gear and said second gear engaging each other to drive said drilling string. The method may include providing that said slip apparatus is operable without a downhole sensor. The method may include providing an electronic control and a downhole sensor to control operation of said slip apparatus. Implementations of the described techniques may include hardware, a method or process, or computer software on a computer-accessible medium.

One general aspect includes a downhole ratchet connectable in a drilling string to release torsional energy from the drilling string when drilling a wellbore. The downhole ratchet also includes a first gear mounted to rotate with the first tubular; a second gear mounted to rotate with the second tubular, and a bias member that urges gear engagement between the first gear and the second gear.

Implementations may include one or more of the following features. The downhole ratchet may include a rotating connection between the first tubular and the second tubular. The rotating connection is operable to support a weight of the drilling string below a downhole position of the downhole ratchet. The downhole ratchet may include a housing with the first gear being slidingly mounted with respect to the housing. The bias member urges the first gear into sliding engagement the second gear. The downhole ratchet is operable without electronics.

One general aspect includes a downhole ratchet connectable in a drilling string to release torsional energy from the drilling string when drilling a wellbore. The downhole ratchet also includes a first gear mounted to rotate with the first tubular; a second gear mounted to rotate with the second tubular, and a rotating connection that permits rotation between the first tubular and the second tubular.

Implementations may include one or more of the following features. The downhole ratchet where the rotating connection is operable to support a weight of the drilling string below a downhole position of the downhole ratchet in the drilling string. The downhole ratchet may include a bias member that urges gear engagement between the first gear and the second gear. The downhole ratchet may include a housing, the first gear being slidingly mounted with respect to the housing. The bias member urges the first gear into the second gear. The downhole ratchet is operable without electronics.

One general aspect includes a downhole ratchet connectable in a drilling string to release torsional energy from the drilling string when drilling a wellbore. The downhole ratchet also includes a first component, a first threaded connection on the first component, the first threaded connection being threadably connectable with the first tubular. The ratchet also includes a second component mounted for rotation with respect to the first component, a second threaded connection on the second component, the second threaded connection being threadably connectable with the second tubular. The ratchet also includes the first component and the second component may include a mechanical arrangement that locks the first tubular and the second tubular together for drilling, the mechanical arrangement releasing the first tubular with respect to the second tubular to release torsional energy from the drilling string. The ratchet also includes the mechanical arrangement being operable without requiring electronics.

Implementations may include one or more of the following features. The downhole ratchet where the mechanical arrangement further may include a first gear mounted to rotate with the first tubular, and a second gear mounted to rotate with the second tubular. The mechanical arrangement further may include a bias member that urges gear engagement between the first gear and the second gear. The downhole ratchet wherein the mechanical arrangement further may include a housing, the first gear, the second gear, and the bias member being mounted in the housing. The mechanical arrangement further may include a rotating connection between the first gear and the second gear. The rotating connection is operable to support a weight of the drilling string below a downhole position of the downhole ratchet in the drilling string.

One general aspect includes a ratchet connectable in a drilling string to release torsional energy from said drilling string when drilling a wellbore, said drilling string extending from the surface to a drill bit, said ratchet being connectable between a first tubular and a second tubular in said drilling string, said ratchet including: a body; a first threaded connection on said body, said first threaded connection being threadably connectable with said first tubular; a first component mounted for rotation with respect to said body, a second threaded connection on said first component, said second threaded connection being threadably connectable with said second tubular; and a second component, said first component and said second component being mechanically linked to lock said first and second tubulars together when said second tubular rotates at a velocity equal to or less than said first tubular, and permit relative rotation between said first and second tubulars when said second tubular rotates at a velocity greater than said first tubular to thereby release torsional energy from said drilling string.

By gear the meaning would specifically include a toothed wheel as an example. However, the more general meaning is intended that gears are defined as mechanical components that transmit/control rotation and power transfer from one shaft to another. In this case, the two shafts are the drill pipe above and below the downhole ratchet. There are many known mechanisms for ratchets. For example, a hinged tooth is considered a gear when arranged to control power transfer between the two pipes. A pipe gripping mechanism can be a gear to transmit power. Other shapes of gears, teeth arrangement, gripping/releasing components and mechanisms, and the like are possible. It will be appreciated from the drawings below by one of skill that the downhole ratchet is purely mechanical and works without need of sensors or other downhole electronics to control operation.

DETAILED DESCRIPTION

Figure 1:
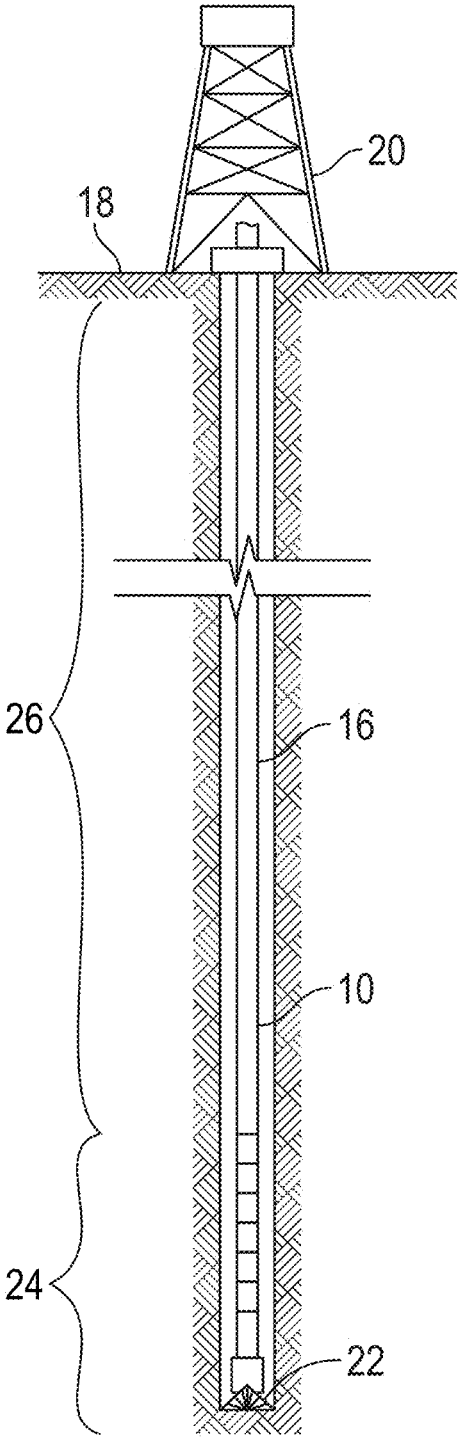
FIG. 1 discloses a drill string and one or more downhole ratchets located at selected positions in the drill string in accord with one possible embodiment of the invention.
Figure 2:
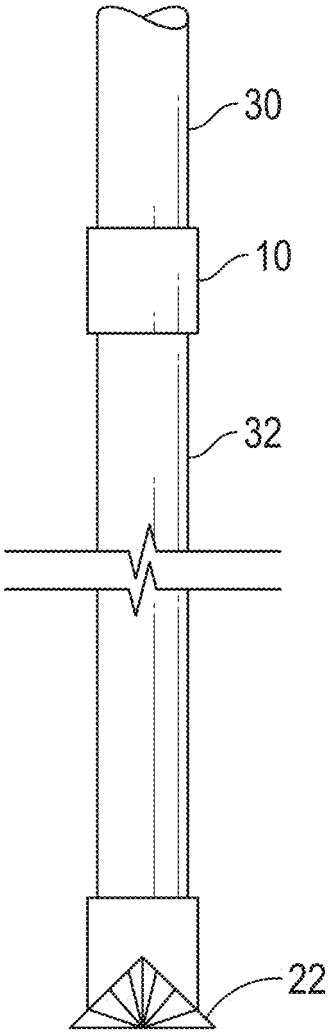
FIG. 2 discloses a ratchet mounted in the drill string between a first tubular, which may be an upper tubular, and a second tubular, which may be a lower tubular in the drill string in accord with one possible embodiment of the invention.

FIG. 1 shows a drill string 16 in which ratchet 10 could be mounted at a downhole position in the drilling string as shown in FIG. 1 and FIG. 2. Slip mechanisms may also be referred to herein as ratchet mechanisms or the like. The drill string 16 extends from an earth surface 18 to the drill bit 22. Surface drive 20 applies torque to rotate the drill sting to rotate the bit. Alternatively, or in addition, the bit 22 may be driven by a downhole motor. In other words, a drive that produces rotational drilling force may be a top drive, rotary table, or downhole motor.

The drill string 16 comprises a bottom hole assembly (BHA) 24 and a pipe string 26. The pipe string may also be referred to as a drill pipe portion or other related terminology. The BHA 24 is at a lowermost position in the drill string 16. The BHA 24 comprises a bit and components such as a bit sub, drill collar, heavyweight drill collar, heavy weight drill pipe, stabilizer, reamer, shock, hole opener, downhole motor, rotary steerable system, directional equipment, drilling while measurement equipment, steering unit, near bit inclination, and/or non-magnetic drill collar. While in FIG. 1 a top drive or rotary table drive on the surface is utilized to rotate the drill string, many wells are drilled with a downhole motor instead of the top/rotary drive or in addition therewith.

The BHA is connected to the drill pipe portion 26 of the drillstring. The drill pipe portion 26 comprises additional components such as drill pipe, coiled tubing, heavyweight drill pipe, and/or stabilizer. The drill pipe portion 26 of the drill string is typically much longer than the BHA. Where the BHA may typically be in the range of 100 to 400 feet, the drill pipe portion 26 of the drill string may be several miles long.

During normal drilling, the slip mechanism 10 operates the same as other tubulars in the drill string to convey power from the top drive to the drill bit. When Slip-stick occurs so that the drill bit sticks and then comes loose, the bit accelerates to a higher rotation velocity than the drill string velocity driven by the top drive, rotary table or downhole motor. At this time, the slip mechanism 10 allows the tubulars below to rotate independently with respect to the tubular above.

Figure 3:
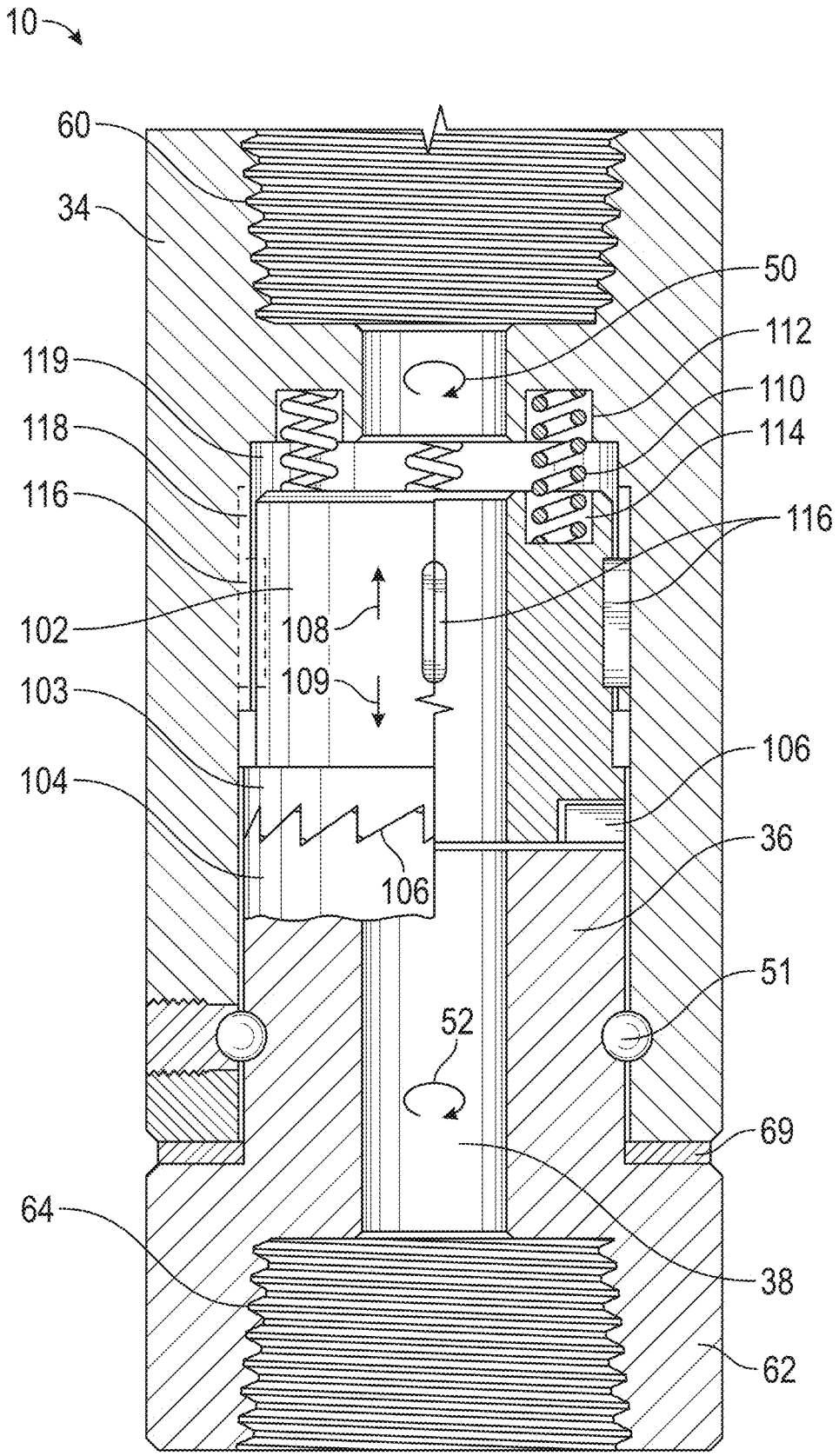
FIG. 3 is an elevational view, partially in cross-section, of a downhole ratchet showing a vertical cross-section extent thereof in accord with one possible embodiment of the present invention.

FIG. 3 shows slip mechanism 10, a mechanical arrangement that creates a type of downhole ratchet, that comprises slidably mounted upper gear 102, 103 and lower gear 104 that grip upper tubular 30 (FIG. 2) and lower tubular 32 (FIG. 2) and allow/prevent rotation. Slippage depends on forces related to the relative velocity of outer body 34 and inner body 36 and lower portion 62 thereof as indicated by rotational arrows 50, 52. Upper gear 103 and lower gear 104 slide with respect to each in response to slip-stick to release torsional energy produced by the slip-stick to control torsional energy in the drill string. Otherwise, the drilling force from the drive is transmitted through upper gear 103 and lower gear 104 through the drilling string and the PDC drill bit as normally occurs during drilling. Outer body 34 and inner body 36 form a housing in which the upper gears 102, 103 and lower gears 104 are mounted. A flow path 38 is provided that extends through 10. Ball type bearings 51 are utilized to connect upper tubular to outer body 34 to inner body 36. Other types of rotating connections can be used. Thrust bearing 69 provides a bearing for downward weight so that the rotating connection is operable to support the weight of the drill string below the downhole position in the drill string where the downhole ratchet is mounted. When the velocity of lower tubular 32 (secured to threaded connection 64) is faster than upper tubular 30 (secured to threaded connection 60) then upper gear 102 is pushed upwardly as indicated by arrow 108 against the bias provided by bias members such as, for example, springs 110. Springs 110 push gears 103 and 104 into gear engagement for normal drilling. In other words, gears 103 and 104 are biased into contact. Springs 110 are mounted in pockets such as pocket 112 in outer body 34 and in pocket 114 in moveable gear 103. Note that connectors 60 and 64 may be male or female and more typically connector 60 is female and connector 64 is male. When the velocity of lower tubular 32 is less than or equal to upper tubular 30 then upper gear 102 moves downward due to the bias as indicated by arrow 109. In other words, in this situation, gears 103 and 104 are connected to lock and thereby transmit the rotational drilling force to the PDC bit from a drive, such as a top drive, rotary table, or downhole motor. Upper gear 102 cannot rotate with respect to outer body 34 due to splines 116 that engage corresponding grooves 118 shown in dash. Thus, one of skill looking at FIG. 3 will appreciate that upper gear is mounted to be slidably moveable with respect to the housing and specifically outer body 34. In other words, the first gear is slidingly mounted with respect to the housing and specifically outer body 34.

It will be appreciated for the claims that the terms first component and second component are for convenience and that either of the inner or outer body could be called a first component or second component. The inner body or outer body may also be referred to as an inner tubular or outer tubular. One of skill reviewing FIG. 3 will appreciate that an advantage of the downhole ratchet 10 is that it operates without requiring electronics such as a downhole sensor to monitor rotation and/or rotational speed. One of skill is aware that a ratchet does not require and does not need a downhole sensor such as rotational speed sensor and/or downhole electronics as indicated by FIG. 3 (which one of skill would know clearly does not show or require this feature).

One advantage of downhole ratchet 10 is that very few moving parts are required. The drive force to rotate the bit is transmitted by gear teeth 106 on the two opposing gears. The components of the downhole ratchet 10 are operable to lock together and thereby operable to drive torsional energy or rotational drilling force from the drive, e.g. top drive, through the drilling string to the PDC bit. Otherwise, the components of downhole ratchet 10 are responsive to slip-stick to slip to release torsional energy in the drilling string due to slip-stick.

Accordingly, the upper gear 102 moves up and down in the pocket 119. However upper gear 102 is biased downwardly. It will be appreciated that many types of springs may be utilized instead of coil springs as shown. Outer body 34 is secured to the upper tubular 30 via threaded connection 60. The upper gear 102 has to rotate with the outer body 34 because the pocket 119 comprises splines 116. Because outer body 34 is threadably secured to the upper tubular 30, upper gear 102 is constrained to rotate with the upper tubular 30.

The lower gear 104 connects to the lower tubular 32 through threaded connection 64. The lower gear 104 cannot move axially up and down. During normal drilling, the upper gear 102 drives the lower gear 104, which drives the drill string below the slip mechanism 10.

If due to slip stick, lower gear 104 rotates faster than the upper gear 102 then the spring loaded upper gear 102 is pushed up and slipping occurs between upper gear 102 and lower gear 104 until the velocity of lower gear 104 drops to the driving speed of outer body 34.

This releases torque energy in the drill string to dampen out torque oscillations. Thus, one of skill when viewing the figures will appreciate that said mechanical arrangement of the downhole ratchet 10 allows the upper tubular 30 to rotate with respect to said lower tubular 32 (See also FIG. 1 and FIG. 2) to release torsional energy from said drilling string.

In other words, two saw-toothed gears 102/103, 104 with at least one gear 102 being spring loaded to press against each other with the toothed sides together. Rotating in one direction, the saw teeth of the drive disc lock with the teeth of the driven disc, making it rotate at the same speed. If the drive disc slows down or stops rotating, the teeth of the driven disc slip over the drive disc teeth and continue rotating.

It will be appreciated that the slip mechanism 10 can be built to operate in response to slip-stick without use of a downhole sensor or an electronic control. However, in another design, an electronic sensor could be utilized to provide input to an electronic control to release and lock the slip mechanism 10.

Figure 4:
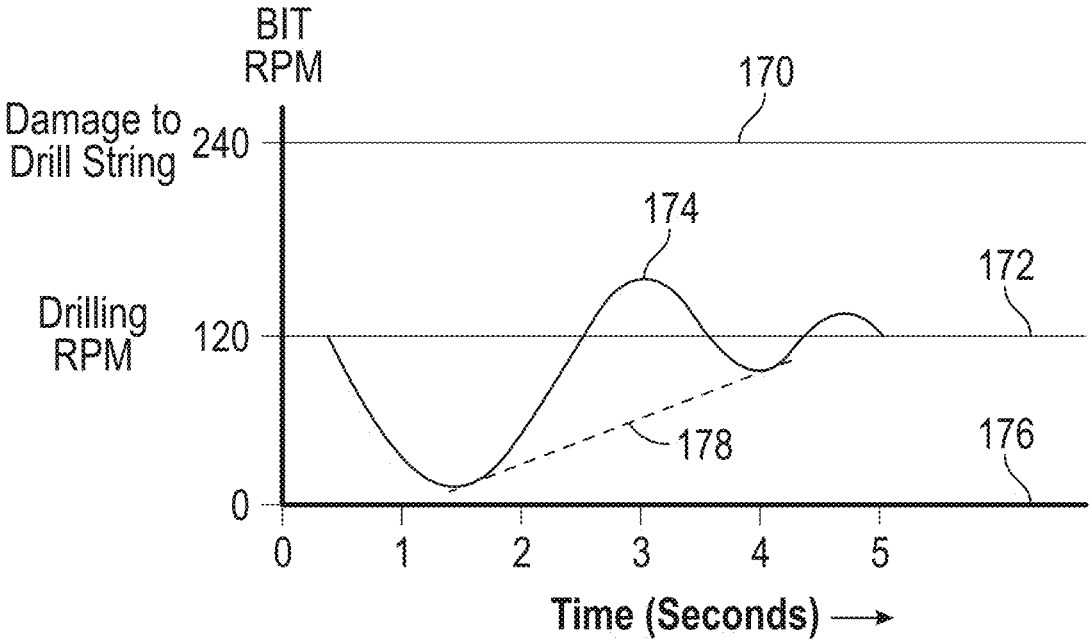
FIG. 4 shows damping of torsional oscillations resulting from placement of a slip mechanism at a first position in a drill string.

FIG. 4 shows the effect of damping of torsional vibrations in bit speed 174 (which may be closely related to the speed measured at lower tubular 32 or speed of inner body 36). Drilling speed 172 may be in the range of 120 RPM or so. The speed at which damage occurs in the drill string is shown at 170, which may be in the range of 240 RPM. Speed indicted at 176 could be in the range of zero RPM if full blown slip-stick is occurring.

As discussed, a type of slip system utilized herein is purely mechanical and may be referred to herein as purely mechanical slip systems, ratchet, or the like. This slip apparatus is connectable between an upper tubular and a lower tubular in the drilling string. This slip system utilizes components that are mechanically linked to lock upper and lower tubulars together when said lower tubular rotates at a velocity equal to or less than said upper tubular, and permit relative rotation between said upper and lower tubulars when said lower tubular rotates at a velocity greater than said upper tubular to thereby release torsional energy from said drilling string.

It would be desirable to maintain torsional potential energy at a constant value. This maintains the constant close contact of the drill bit with the surface to be cut for maximum cutting effects. It would be desirable to provide a tool that would stabilize torsional potential energy within a few cycles back to a constant level.

Location of the ratchet can be accomplished in different ways. In one embodiment, one or more ratchets can be distributed through regions of the drill string. Torque and drag programs, which are commonly used in calculating dynamics of drill strings, are then used to determine how best to locate the one or more ratchets to control damping. Torque and drag problems are very common during drilling, completion and workover operations. A torque and drag module can be used to calculate torque and drag of the drill string during planning, drilling, and post-drilling. Various models for the drill string may be utilized. 3D visualization may be provided. The wellbore friction, torque and drag, between the drill string and the wellbore wall is the most critical issue which limits the drilling industry to go beyond a certain measured depth. Surface torque is defined as the moment required for rotating the entire drill string and the bit on the bottom of the hole. Torque and drag software can be utilized to model slip stick with simulated sticking loads. In this way, software can be used to determine where and how many ratchets to utilize in the drilling string. The software can determine how much torsional energy will be released from a ratchet.

Torque twists the relatively more flexible drill pipe more readily than thick walled pipe so that most of the potential energy from slip-stick is stored in the flexible drill pipe portion of the drilling string. A ratchet or multiple ratchets may preferably be positioned above the bottom hole assembly in the more flexible drill pipe. In one embodiment, multiple ratchets may be positioned every three or four pipes.

Another non-limiting feature of the present invention is to select one or more positions in the drill string for a slip/release mechanism, which releases/grabs purely mechanically without electronic or hydraulic controls, where the positions are used to adjust an amount of damping of the torsional oscillation.

A method for controlling an amount of damping of torsional oscillations in a drill string utilizing a slip system, said method comprising the steps of:

utilizing a processor to make torque and drag calculations on said drillstring, said drillstring comprising a BHA (bottom hole assembly) and a drill pipe portion;

said BHA being at a lowermost position in said drillstring, said BHA comprising a bit and components comprising one or more of a bit sub, drill collar, heavyweight drill collar, heavy weight drill pipe, stabilizer, reamer, shock, hole opener, downhole motor, rotary steerable system, directional equipment, drilling while measurement equipment, steering unit, near bit inclination, non-magnetic drill collar, said BHA being connected to said drill pipe portion of said drillstring, said drill pipe portion comprising additional of said components comprising one or more of a drill pipe, coiled tubing, heavyweight drill pipe, stabilizer; and utilizing said torque and drag calculations on said drillstring for determining one or more positions for one or more slip systems from a plurality of different positions in said drillstring to control said amount of damping of torsional oscillations in said drillstring.

In a presently preferred embodiment, at least one ratchet is positioned one or more pipe joints above the bottom hole assembly, and perhaps as many as ten joints, depending on how much rotation is expected. However, positioning a few slip mechanisms every two or three joints above the bottom hole assembly may be effective in another embodiment.

It will be understood that the ratchet assembly may be used with rotary tables and downhole motors.

Another objective is to release the lower portion of a drillstring to stabilize torsional potential energy of said drillstring.

Another objective is to limit axial lengthening/shortening of the drill string to the point where bit bounce is eliminated—for longer bit life and improved positioning of the PDC cutters to maximize drilling rate.

In another embodiment, a system for drilling a straight hole in with respect to a perpendicular axis of a surface of earth or a low angle hole less than fifteen degrees with respect to said perpendicular axis of said surface of said earth is provided. The system comprises:

a bottom hole assembly positioned at a bottommost end of a drill string, said bottom hole assembly comprises one or more components comprising one or more of a bit, bit sub, drill collars, heavyweight drill collars, heavy weight drill pipes, stabilizers, reamers, shocks, hole openers, downhole motor, rotary steerable system, directional drilling while measurement equipment, steering unit, near bit inclination, non-magnetic drill collar, said bottom hole assembly being connected to a drill pipe portion of said drill pipe, providing that said drill pipe portion comprises drill pipe, coiled tubing, or heavyweight drill pipe;

a mechanism positioned above a center point along an axis through said bottom hole assembly, said mechanism comprises rigid moveable members;

said mechanism allows relative movement rigid metal element slipping rotation a lower portion of said bottom hole assembly below said center point in response to said drill bit sticking and starting.

To improve PDC bit performance in the face of slip-stick, the present invention positions a ratchet in a region in the drill string that is likely to experience a maximum or at least a relatively high potential energy increase due to slip stick. The region in which the ratchet may be most effective at reducing the effects of slip stick may be in stress regions. For example, the transition region between the bottom hole assembly and the drill pipe is a region that is likely to experience a relatively higher or maximum potential increase due to slip stick. In some cases, one or more transition pipes are utilized in the drill string that provide a gradual shift in stiffness between the relatively flexible drill pipe and the relatively rigid BHA (which includes drill collars). This reduces stress concentrations and fatigue failures that can occur at the junction.

Other regions that cause stress in the drill string might include dog legs or sharp bends in the wellbore or regions in which the wellbore is tighter. Providing a ratchet above these stress regions can bleed energy from pulses produced by slip stick that propagate up the drill string.

In general, the bottom hole assembly is typically much more rigid or stiff that the relatively flexible drilling pipe to which it is attached. Accordingly, the BHA is less likely to absorb additional potential torsional energy that is capable of accelerating the bit once it sticks and releases. However the drill pipe, which is considerably more flexible, forms a spring that is capable of doing just this, i.e. accelerating the bit after it stops. Moreover assuming the pulses of energy produced by slip stick largely begin at the transition points such as between the BHA and drill pipe, this is believed to be the region in which the ratchet is best able to drain excess torsional potential energy produced by slip stick.

For reducing slip stick with a ratchet in a drill string, putting the ratchet just above the bottom hole assembly (BHA) in the drill pipe may be the best location. The BHA is much more rigid than the drill pipe. So when the bit sticks, in this model, the entire rigid BHA also effectively sticks, and practically all of the potential torsional energy build up due to slip stick occurs at least initially in the drill pipe nearest the BHA. As compared to the relatively rigid BHA, the drill pipe is effectively a torsional spring that is naturally friction damped by wellbore.

So once the BHA is released and speeds past the drilling speeds then the ratchet releases excess torsional energy due to slip stick. Bit speed arrow 174 is also approximately the maximum bit speed due to the slip stick. One region to put the ratchet would be just above the BHA to maximize the removal of the excess torsional potential energy added to the drill string due to slip stick. The operation of the downhole ratchet would occur on the upper pulses that are at speeds above the drilling rpm 120 and therefore allow the energy to rotate the BHA which is also at some amount of friction until the BHA slows down to drilling rpm whereupon the ratchet reengages.

Accordingly, in one embodiment, the ratchet is positioned perhaps plus or minus 200 feet from the transition between the drill pipe and the BHA or any range within this range such, e.g., without limitation plus or minus within 50 feet. Thus any range within this is considered supported if the matter is claimed for patent purposes without the need to specify each range within the above range.

Because the drill pipe is most likely going to absorb most of the torsional potential energy caused by slip stick, locating the ratchet within the drill pipe may be the best option. Preferably the ratchet would be located in the upper half of the drill pipe. Thus, in one embodiment the ratchet is positioned between a middle region of the drill pipe and the transition region between the drill pipe and the BHA.

While simulating the drill string with software is probably the best way to locate the best location for one or more ratchet and test for simulate testing for maximum protection from slip-stick, if software is not used then placing a ratchet above the BHA to mitigate stick-slip in a drill string has some common sense logic to it.

For example:

Localized Energy Storage: The BHA's rigidity means that when the bit sticks, the initial torsional energy builds up primarily in the drill pipe closest to the BHA.

Targeted Energy Release: Positioning the ratchet just above the BHA allows it to directly address this concentrated energy zone. When the bit breaks free and the BHA accelerates, the ratchet will engage and dissipate the excess energy, preventing it from propagating as a damaging torsional wave up the drill string.

Reduced Stress on the BHA: By absorbing some of the shock loading, the ratchet could potentially reduce stress and fatigue on the BHA components, which are often expensive and critical to the drilling operation.

Referring to FIG. 4, the resulting maximum speed of the drill bit depends on how long the bit is stuck. For example if the bit comes to zero speed and is held there for more time, then the maximum speed indicated roughly at 174 will increase and may reach speed greater than 240 RPM as indicated at 170 which may cause damage to the drilling string. During operation, the ratchet allows free spinning approximately when the bit speed increases above the driven bit speed indicated at 172. If the bit had stuck for longer and created a larger first peak at 172 then the second peak (not labeled) could have also activated free spinning of the ratchet. In other words, the ratchet operates on every other pulse, the pulses that are higher than the bit speed. The downhole may further comprise a sensor for sensing a selected type of movement of the drill bit (ratchet or drill string below ratchet) wherein the sensor is sensitive to a programmable amount of acceleration movement of the drill bit (ratchet or drill string below ratchet). In one embodiment, the rotational slippage may be activated in response to acceleration but before a selected rotational speed occurs to thereby release more torsional energy. For instance, it may be desirable to release the torsional energy before the drilling bit reaches the drilling driving rotational speed. The one or more moveable members comprise one or more electromagnetic coils controlled by one or more valves.

The present invention may also comprise a computer simulation to determine the best location in the drill string and the resulting effect of the ratchet operation or perhaps activating a rotational control mounted in a drilling string where the rotational control may be operable for selectively transferring torque between tubulars in the drilling string, such as with an on-off clutch type mechanism or a variable control. The method of the computer simulation may comprise one or more steps such as, for instance, providing parameter inputs for inputting drill string parameters describing the drilling string, providing one or more rotational control activation parameter for inputting conditions under which the rotational control is activated, and providing one or more outputs related to torsional oscillations of a drill bit (ratchet or drill string below ratchet) of the drilling string. The method may also comprise plotting drill bit (ratchet or drill string below ratchet) movement versus time wherein the rotational control is activated to permit slippage between the tubulars in the drilling string to dampen the torsional oscillations. For instance, the drill string length, weight, and so forth may be entered. The particular timing for activating the rotational control, e.g., on-off clutch, may be tested in any desired way for any acceleration, rotational speed, or any combination of such parameters for the drill string below the ratchet. In another embodiment, a method is provided which may comprise one or more steps such as, for instance, installing a clutch assembly in the drilling string between a lower tubular of the drilling string and an upper tubular of the drilling string and/or selectively engaging the clutch to transfer torque between the lower tubular portion of the drilling string and the upper tubular of the drilling string during a drilling operation and/or selectively disengaging the clutch to permit slippage between the upper tubular of the drilling string and the lower tubular of the drilling string during the drilling operation to thereby dampen the drill bit (ratchet or drill string below ratchet) oscillations.

In addition to determining the best location for one or more slip mechanisms in the drill string to maintain constant torsional potential energy, the method may further comprise sensing movement of the drill bit which indicates the drill bit oscillations are likely to occur. The method may further comprise performing the step of selectively disengaging in response to said step of sensing.

The method may further comprise selectively partially disengaging or engaging the clutch to permit some slippage but also to transfer torque but not all torque.

In another embodiment, with the ratchet mounted above the BHA, an upper tubular may be utilized as a pulse reflector has thicker walls than the drill pipe and perhaps centralizers. This changes the impedance drill string and therefore the torsional pulse is at least partially reflected by the reflector back into the ratchet assembly for further reduction of amplitude of the torsional pulse.

In another embodiment, a freewheeling clutch may be utilized. A freewheeling clutch, also known as an overrunning clutch or one-way clutch, is a mechanical device that allows rotation in one direction but not the other. It essentially acts like a ratchet, transmitting torque in one direction while allowing free rotation in the opposite direction. A very well-known example of a freewheeling clutch is mounted in a bicycle wheel. When pedaling forward, the chain turns the rear wheel, propelling the user forward. But when pedaling stops, the wheel continues to spin freely, allowing coasting.

Inside a typical freewheeling clutch as used herein, an inner race connects to the driving shaft that connects to the drill bit, an outer race connected to the driven shaft (e.g., the drill pipe above). and rollers or sprags that may be positioned between the inner and outer races. Generally components positioned between the inner and outer races wedge or grip with one direction of rotation between the inner and outer races and allow motion otherwise. For example, rollers or sprags are wedge-shaped and designed to lock into place when the inner race rotates in one direction, transmitting torque to the outer race. When the inner race stops or rotates in the opposite direction, the rollers or sprags retract, allowing the outer race to rotate freely. Sprags are non-revolving, asymmetrically shaped elements.

Figure 6:
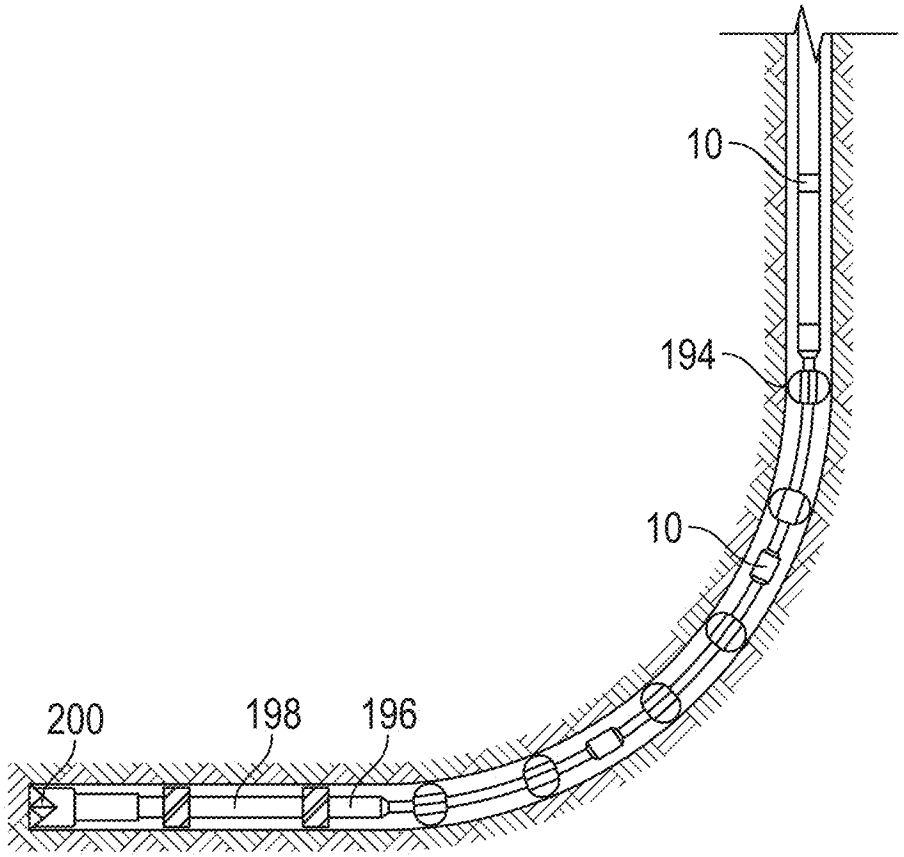
FIG. 6 is an elevational view showing use of one or more slip mechanisms in a horizontal BHA in accord with one embodiment of the present invention.
Figure 5:
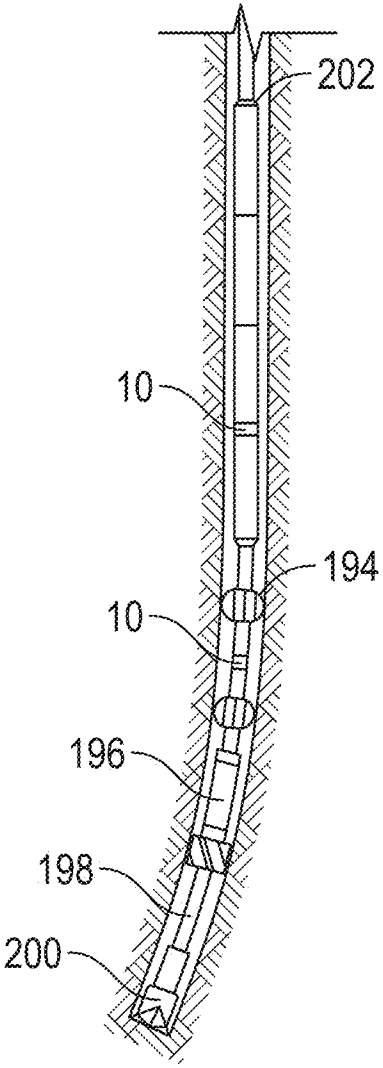
FIG. 5 is an elevational view showing use of one or more slip mechanisms in a medium angle building bottom hole assembly.

FIG. 5 shows a medium angle building BHA. FIG. 6 shows a horizontal drilling BHA. In both drilling assemblies, bit 200 is driven by motor system 198. Directional instruments are located in non-magnetic tubulars 196. The kick off point is indicated by 194. The vertical section is shown. In this example, the vertical section is also the heavyweight pipe. In 5, the top 202 of the BHA is shown. In this example, two slip assemblies 10 are utilized. As discussed above, it might also be desirable to place the ratchet, or other type of slip assembly, at the top of the heavyweight section at 202. In this environment another transition region is at 194. However, the best way to determine the location on a particular well would be based on the particular well dynamics. Because the downhole motor 198 is at the bottom of the drilling string, slip mechanism 10 may utilize reversed teeth arrangements from that shown previously but otherwise operate the same. If slip system 10 is placed beneath the motor system, then this is not necessary.

A slip system is used herein to release torsional energy from the drilling string when drilling a wellbore. As a further refinement, the position or positions of placement of the slip system(s) within the drilling string is utilized to control the amount of damping of torsional oscillations produced by slip-stick.

One or more slip systems may be utilized to release torsional energy from the drilling string in order to dampen torsional oscillations due to slip stick.

As discussed below, one type of slip system utilized herein is purely mechanical and may be referred to herein as purely mechanical slip systems, ratchet, or the like. This slip apparatus is connectable between an upper tubular and a lower tubular in the drilling string. This slip system utilizes components that are mechanically linked to lock upper and lower tubulars together when said lower tubular rotates at a velocity equal to or less than said upper tubular, and permit relative rotation between said upper and lower tubulars when said lower tubular rotates at a velocity greater than said upper tubular to thereby release torsional energy from said drilling string.

Many additional changes in the details, components, steps, and organization of the system, herein described and illustrated to explain the nature of the invention, may be made by those skilled in the art within the principle and scope of the invention. For example, many different types of rotational control systems or slip mechanisms may be utilized to produce similar torsional energy stabilizing results in response to slip-stick if positioned in the well at the desired positions or regions of the drill string as discussed herein. These may include purely mechanical non-electronic or electronically or hydraulically slip mechanisms controlled located at a region or position determined to be effective at releasing unwanted torsional energy due to slip-stick and/or maintaining constant potential torsional energy in the drill string. It is therefore understood that within the scope of the appended claims, the invention may be practiced otherwise than as specifically described.

The invention claimed is:

1. A system to improve drill bit performance of a PDC (polycrystalline diamond compact) drill bit by controlling slip-stick, said system comprising a slip apparatus connectable in a drilling string that is positioned in said drilling string to release torsional energy from said drilling string produced due to slip-stick during drilling of a wellbore, said drilling string extending from the surface to said PDC drill bit, said PDC drill bit being rotated by a drive that produces a rotational drilling force, said slip apparatus being connectable between a first tubular and a second tubular in said drilling string, said drilling string comprising drill pipe and a BHA (bottom hole assembly), a transition region between said drill pipe and said BHA, a middle region of said drilling string, said system comprising: a first component of said slip apparatus being threadably connectable with said first tubular; a second component of said slip apparatus being threadably connectable with said second tubular; said first component and said second component being mechanically connected to lock said first tubular and said second tubular together to transmit rotational energy produced by said drive through the first tubular and said second tubular while drilling with said PDC drill bit, said first component and said second component being mechanically connected to permit relative rotation between said first tubular and said second tubular in response to slip-stick; and said slip apparatus being positioned in or between said transition region and said middle region of said drilling string; and wherein said first component and said second component are mechanically linked to lock said first tubular and said second tubular together when said second tubular rotates at a velocity equal to or less than said first tubular, and permit relative rotation between said first tubular and said second tubular when said second tubular rotates at a velocity greater than said first tubular thereby releasing torsional energy from said drilling string.

2. The system of claim 1, further comprising: a computer programmed to perform calculations on said drilling string to determine a position for mounting said slip apparatus in or between said transition region and said middle region of said drilling string to control damping of torsional energy in said drilling string due to said slip-stick.

3. The system of claim 2, wherein said computer is programmed to compare an effect of slip-stick on said drilling string when said slip apparatus is positioned at different positions in said drilling string.

4. The system of claim 1, wherein said slip apparatus comprises a first gear mounted to rotate with said first tubular; and a second gear mounted to rotate with said second tubular.

5. The system of claim 4, wherein said slip apparatus comprises a bias member that urges gear engagement between said first gear and said second gear.

6. The system of claim 5 comprising gear teeth on said first gear and said second gear, said gear teeth comprising surfaces that are angled with respect to an axis through said first tubular and said second tubular to permit rotationally sliding engagement of said gear teeth in response to said slip-stick, said gear teeth on said first gear and said second gear being arranged to otherwise lock together to allow said rotational drilling force to rotate said PDC drill bit.

7. The system of claim 1, wherein said slip apparatus is operable without a downhole sensor.

8. The system of claim 1, further comprising an electronic control and a downhole sensor to control operation of said slip apparatus.

9. A method for drilling a wellbore with a PDC (polycrystalline diamond compact) drill bit, a slip apparatus connectable in a drilling string, said slip apparatus being positioned in said drilling string to release torsional energy from said drilling string produced due to slip-stick during drilling of a wellbore, said drilling string extending from the surface to said PDC drill bit, said drilling string comprising a BHA (bottom hole assembly) and a length of drill pipe longer than said BHA, a drive to produce rotational drilling force to rotate said PDC drill bit for drilling said wellbore, a transition region between said length of drill pipe and said BHA, a middle region of said drilling string, said method comprising: providing a first component of said slip apparatus, providing a second component of said slip apparatus, positioning said slip apparatus in or between said transition region and said middle region of said drilling string; and providing that said first component and said second component are mechanically connected to lock together to transmit said rotational drilling force while drilling with said PDC drill bit, and to permit relative rotation between said first component and said second component in response to slip-stick to thereby release torsional energy from said drilling string, said first component being connected to rotate with a first tubular and said second component being connected to rotate with a second tubular, wherein said first component and said second component permit relative rotation between said first tubular and said second tubular when said second tubular rotates at a velocity greater than said first tubular responsively to said slip-stick.

10. The method of claim 9, comprising providing a first gear in said first component that rotates with said first tubular; providing a second gear in said second component that rotates with said second tubular; providing that said first gear is biased into contact with said second gear; providing that said first gear and said second gear are operable to lock together to provide rotational drilling force to said PDC drill bit; and providing that said first gear and said second gear are responsive to slip-stick to slidingly rotate against each other to thereby release said torsional energy in said drilling string produced due to said slip-stick while drilling said wellbore with said PDC bit.

11. The method of claim 9, further comprising: providing a computer programmed to make calculations on said drilling string for determining a position for said slip apparatus from a plurality of different positions in or between said transition region and said middle region of said drilling string to control damping of torsional energy in said drilling string due to said slip-stick.

12. The method of claim 9, comprising providing that said slip apparatus is operable without a downhole sensor.

13. The method of claim 9, comprising providing an electronic control and a downhole sensor to control operation of said slip apparatus.

14. A method for drilling a wellbore with a PDC (polycrystalline diamond compact) drill bit, a slip apparatus that is positioned in said drilling string to release torsional energy from said drilling string produced due to slip-stick during drilling of a wellbore, said drilling string extending from the surface to said PDC drill bit, said drilling string comprising a (bottom hole assembly) BHA and a length of drill pipe longer than said BHA, a drive to produce rotational drilling force to rotate said PDC drill bit for drilling said wellbore, a transition region between said length of drill pipe and said BHA, a middle region of said drilling string, said method comprising: providing that said slip apparatus is operable to drive said drilling string or to release torsional energy; utilizing a processor to make torque and drag calculations on said drilling string; said BHA comprising said PDC drill bit and components comprising one or more of a bit sub, drill collar, heavyweight drill collar, heavy weight drill pipe, stabilizer, reamer, shock, hole opener, downhole motor, rotary steerable system, directional equipment, measurement while drilling equipment, steering unit, near bit inclination, non-magnetic drill collar said length of drill pipe comprising one or more of a drill pipe, coiled tubing, heavyweight drill pipe, or a stabilizer; and utilizing said torque and drag calculations on said drilling string for determining a position for said slip apparatus in said drilling string to control torsional energy in said drilling string produced by slip-stick; and positioning said slip apparatus in said drilling string at the determined position.

15. The method of claim 14, further comprising providing that said slip apparatus locks a first tubular and a second tubular in said drilling string together to transmit said rotational drilling force through said drilling string when drilling with said PDC drill bit, and permits relative rotation between said first tubular and second tubular in response to slip-stick to thereby release torsional energy due to slip-stick from said drilling string.

16. The method of claim 14, providing said slip apparatus comprises a first gear slidably mounted to a first tubular in said drilling string and a second gear secured to a second tubular in said drilling string, and providing that said first gear and said second gear engage each other to drive said drilling string.

17. The method of claim 14, comprising providing that said slip apparatus is operable without a downhole sensor.

18. The method of claim 14, comprising providing an electronic control and a downhole sensor to control operation of said slip apparatus.

* * * * *